US006695720B2

(12) United States Patent
Sullivan

(10) Patent No.: US 6,695,720 B2
(45) Date of Patent: Feb. 24, 2004

(54) GOLF BALL WITH VARYING LAND SURFACES

(75) Inventor: Michael J. Sullivan, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/157,364

(22) Filed: May 29, 2002

(65) Prior Publication Data

US 2003/0224878 A1 Dec. 4, 2003

(51) Int. Cl.[7] ..... A63B 37/12
(52) U.S. Cl. ..... 473/378
(58) Field of Search ..... 473/378, 379, 473/380, 381, 382, 383, 384

(56) References Cited

U.S. PATENT DOCUMENTS

| | | | | | |
|---|---|---|---|---|---|
| 1,681,167 | A | * | 5/1928 | Beldam | 473/383 |
| 4,090,716 | A | | 5/1978 | Martin | 273/232 |
| 4,142,727 | A | * | 3/1979 | Shaw et al. | 473/381 |
| 4,560,168 | A | | 12/1985 | Aoyama | 273/232 |
| 4,729,861 | A | * | 3/1988 | Lynch et al. | 264/219 |
| 4,830,378 | A | | 5/1989 | Aoyama | 273/232 |
| 4,869,512 | A | | 9/1989 | Nomura et al. | 273/232 |
| 4,960,282 | A | | 10/1990 | Shaw | 273/232 |
| 4,995,613 | A | | 2/1991 | Walker | 273/183 |
| 5,060,954 | A | * | 10/1991 | Gobush | 473/379 |
| 5,174,578 | A | | 12/1992 | Oka et al. | 273/232 |
| 5,201,523 | A | * | 4/1993 | Miller | 473/383 |
| 5,209,485 | A | | 5/1993 | Nesbitt et al. | 273/218 |
| 5,292,132 | A | * | 3/1994 | Oka | 473/384 |
| 5,377,989 | A | | 1/1995 | Machin | 273/232 |
| 5,566,943 | A | | 10/1996 | Boehm | 473/384 |
| 5,575,477 | A | * | 11/1996 | Hwang | 473/379 |
| 5,722,903 | A | * | 3/1998 | Moriyama et al. | 473/384 |
| 5,957,786 | A | | 9/1999 | Aoyama | 473/379 |
| 6,126,559 | A | * | 10/2000 | Sullivan et al. | 473/378 |
| 6,290,615 | B1 | | 9/2001 | Ogg | 473/378 |
| D449,358 | S | * | 10/2001 | Ogg | D21/708 |
| 6,358,161 | B1 | | 3/2002 | Aoyama | 473/383 |
| 6,409,615 | B1 | * | 6/2002 | McGuire et al. | 473/383 |

OTHER PUBLICATIONS

Golf Ball's Historic Flight, Leonard Shapiro, Washington Post.

* cited by examiner

*Primary Examiner*—Stephen Blau
*Assistant Examiner*—Tom P Duong

(57) ABSTRACT

A golf ball comprising a substantially spherical outer surface and a plurality of polygonal dimples formed thereon is provided. The dimples are arranged such that the sides of adjacent dimples are substantially parallel to each other, and wherein the outer surface comprises first spacings and second spacings between adjacent dimples. The first spacings and the second spacings have substantially constant width between any two adjacent dimples and the width of the first spacings is different than the width of the second spacings. The plurality of polygonal dimples is arranged in a plurality of identifiable sections and the first spacings comprise inter-dimple spacings between dimples within one identifiable section and the second spacings comprise inter-sectional spacings between identifiable sections of dimples.

Another golf ball comprising a substantially spherical outer surface and a plurality of partially circular dimples formed thereon is also provided. Each of the partially circular dimples comprises a linear side and the dimples are arranged such that the linear sides of opposite partially circular dimples are substantially parallel to each other. The linear sides of any two opposite partially circular dimples form spacing on the outer surface of the ball.

8 Claims, 6 Drawing Sheets

GOLF BALL WITH VARYING LAND SURFACES

FIELD OF THE INVENTION

The present invention relates to golf balls, and more particularly, to a golf ball having improved dimple patterns.

BACKGROUND OF THE INVENTION

Golf balls generally include a spherical outer surface with a plurality of dimples formed thereon. Conventional dimples are circular depressions that reduce drag and increase lift. These dimples are formed where a dimple wall slopes away from the outer surface of the ball forming the depression.

Drag is the air resistance that opposes the golf ball's flight direction. As the ball travels through the air, the air that surrounds the ball has different velocities thus, different pressures. The air exerts maximum pressure at a stagnation point on the front of the ball. The air then flows around the surface of the ball with an increased velocity and reduced pressure. At some separation point, the air separates from the surface of the ball and generates a large turbulent flow area behind the ball. This flow area, which is called the wake, has low pressure. The difference between the high pressure in front of the ball and the low pressure behind the ball slows the ball down. This is the primary source of drag for golf balls.

The dimples on the golf ball cause a thin boundary layer of air adjacent to the ball's outer surface to flow in a turbulent manner. Thus, the thin boundary layer is called a turbulent boundary layer. The turbulence energizes the boundary layer and helps move the separation point further backward, so that the layer stays attached further along the ball's outer surface. As a result, there is a reduction in the area of the wake, an increase in the pressure behind the ball, and a substantial reduction in drag. It is the circumference of each dimple, where the dimple wall drops away from the outer surface of the ball, which actually creates the turbulence in the boundary layer.

Lift is an upward force on the ball that is created by a difference in pressure between the top of the ball and the bottom of the ball. This difference in pressure is created by a warp in the airflow that results from the ball's backspin. Due to the backspin, the top of the ball moves with the airflow, which delays the air separation point to a location further backward. Conversely, the bottom of the ball moves against the airflow, which moves the separation point forward. This asymmetrical separation creates an arch in the flow pattern that requires the air that flows over the top of the ball to move faster than the air that flows along the bottom of the ball. As a result, the air above the ball is at a lower pressure than the air underneath the ball. This pressure difference results in the overall force, called lift, which is exerted upwardly on the ball. The circumference of each dimple is important in optimizing this flow phenomenon, as well.

By using dimples to decrease drag and increase lift, almost every golf ball manufacturer has increased their golf ball flight distances. In order to improve ball performance, it is desirable to have a large number of dimples, hence a large amount of dimple circumference, which is evenly distributed around the ball. In arranging the dimples, an attempt is made to minimize the space between dimples, because such space does not improve aerodynamic performance of the ball. In practical terms, this usually translates into 300 to 500 circular dimples with a conventional sized dimple having a diameter that typically ranges from about 0.120 inches to about 0.180 inches.

When compared to one conventional size dimple, theoretically, an increased number of small dimples will create greater aerodynamic performance by increasing total dimple circumference. However, in reality small dimples are not always very effective in decreasing drag and increasing lift. This results at least in part from the susceptibility of small dimples to paint flooding. Paint flooding occurs when the paint coat on the golf ball fills the small dimples, and consequently decreases the dimple's aerodynamic effectiveness. On the other hand, a smaller number of large dimples also begin to lose effectiveness. This results from the circumference of one large dimple being less than that of a group of smaller dimples.

Another attempt to improve dimple coverage is to use polygonal dimples with the polyhedron dimple surfaces, i.e., dimple surfaces constructed from one or more planar surfaces, as suggested in a number of patent references including U.S. Pat. Nos. 6,290,615B1, 5,338,039, 5,174,578, 4,090,716, and 4,830,378, among others. Theoretically, higher dimple coverage is attainable with these polygonal dimples. As shown in FIGS. 1 and 2, the land area between the polygonal dimples typically has uniform width throughout the surface of the ball. As the width of the land area decreases, the dimple coverage increases.

As recently reported in the press, due to the recent advances in golf ball compositions and dimple designs, some of the high performance golf balls may eventually exceed the maximum distance of 280 yards ±6%, when impacted by a standard driver at 160 feet per second and at 10° angle as set forth by the United States Golf Association (USGA). (See "Golf Ball's Historic Flight, New Product Is Hailed for Distance, Accuracy," by L. Shapiro, The Washington Post at pp. D1, D4, Mar. 22, 2001). As disclosed in U.S. Pat. No. 5,209,485, to reduce the distance that a golf ball would travel, inefficient dimple patterns and low resilient polymeric compositions are suggested. Low resilient compositions include a blend of a commonly used diene rubber, such as high cis polybutadiene, and a low resilient halogenated butyl rubber. Inefficient dimple patterns include octahedral pattern with dimple free equator and dimple coverage of less than 50%. As disclosed in the '485 patent, the resulting ball travels about 50 yards less than comparative balls and has a coefficient of restitution of about 0.200 less than the coefficient of restitution of comparative balls. The '485 patent theorizes that about 40% of the reduction in distance is attributable to the inefficient design, and about 60% is attributable to the low resilient ball composition. However, the art does not suggest a way to fine-tune the distance of high performance golf balls to adhere to the USGA limit.

As a result, there remains a need in the art to fine tune the distance that a golf ball would travel when impacted without affecting the other desired qualities of the golf ball.

SUMMARY OF THE INVENTION

The present invention is directed to a golf ball, which possesses maximum distance and control.

The present invention is also directed to a golf ball with a modified dimple pattern.

The present invention is also directed to a golf ball with high visibility features on its outer surface.

The present invention is directed to a golf ball comprising a substantially spherical outer surface and a plurality of polygonal dimples formed thereon. The polygonal dimples are arranged such that the sides of adjacent dimples are substantially parallel to each other, and the outer surface comprises first spacings and second spacings between adjacent dimples. The first spacings and the second spacings have substantially constant width between any two adjacent dimples and the width of the first spacings is different than the width of the second spacings.

Preferably the polygonal dimples are arranged in a plurality of identifiable sections and wherein the first spacings comprise inter-dimple spacings between dimples within one identifiable section and the second spacings comprise inter-sectional spacings between identifiable sections of dimples.

In accordance to one aspect of the invention, the inter-sectional spacings are thicker than the inter-dimple spacings.

In accordance to another aspect of the invention, the inter-dimple spacings may vary throughout the golf ball, while the inter-sectional spacings remain constant. Conversely, the inter-sectional spacings may vary throughout the ball, while the inter-sectional spacings remain constant. Alternatively, either the inter-dimple spacings or the inter-sectional spacings may vary, or both may vary.

In accordance to another aspect of the invention, at least some of the inter-dimple spacings are thicker than the inter-sectional spacings.

The invention is also directed to a golf ball comprising a substantially spherical outer surface and a plurality of partially circular dimples formed thereon. Each of the partially circular dimples comprises a linear side and these dimples are arranged such that the linear sides of opposite partially circular dimples are substantially parallel to each other. The linear sides of any two opposite partially circular dimples form a spacing on the outer surface of the ball.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
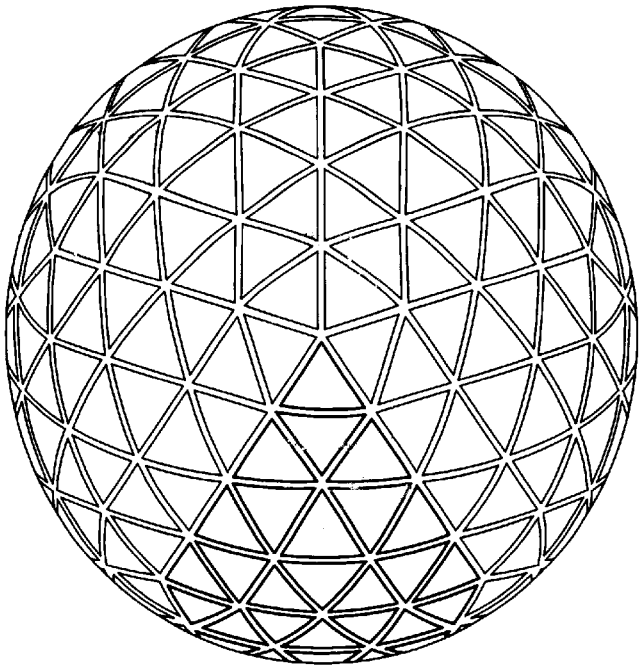
FIG. 1 (PRIOR ART)
FIG. 1 is a plan view of a conventional golf ball with triangular dimples.
Figure 2:
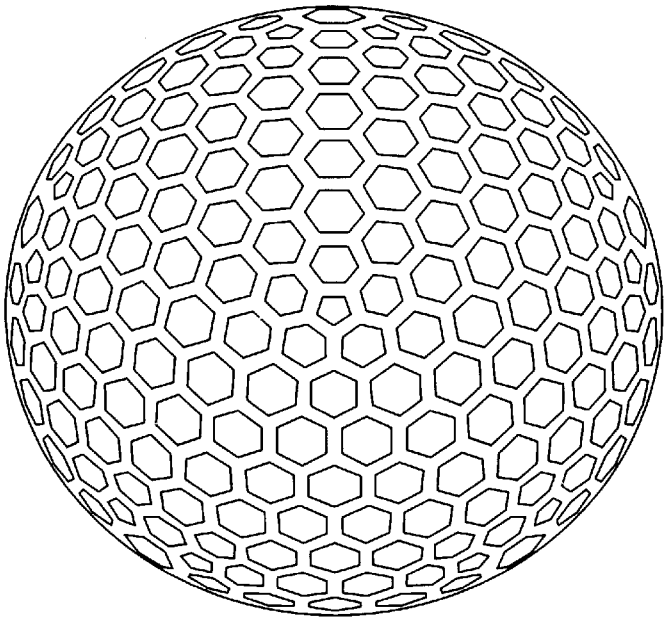
FIG. 2 (PRIOR ART)
FIG. 2 is a plan view of another conventional golf ball with hexagon and pentagon dimples.

With polygonal dimples, the land or un-dimpled surfaces can approach zero when the land surfaces separating the polygonal dimples approach thin lines. As discussed above, with nearly zero land surfaces and highly resilient core/cover materials the golf ball may exceed currently available distance and overall performance levels.

The distance that a golf ball would travel upon impact is a function of the coefficient of restitution (CoR) and the aerodynamic characteristics of the ball. The CoR is defined as the ratio of the relative velocity of two colliding objects after the collision to the relative velocity of the two colliding objects prior to the collision. For golf balls, CoR has been approximated as a ratio of the velocity of the golf ball after impact to the velocity of the golf ball prior to impact. The CoR varies from 0 to 1.0. A CoR value of 1.0 is equivalent to a perfectly elastic collision, and a CoR value of 0.0 is equivalent to a perfectly inelastic collision. The CoR is related to the initial velocity of the ball, which must not exceed 250±5 ft/s, which the maximum limit set forth by the USGA. Hence, the CoR of golf balls are maximized and controlled, so that the initial velocity of the ball does not exceed the USGA limit.

The CoR of the golf ball is affected by a number of factors including the composition the core and the composition of the cover. The core may be single layer core or multi-layer core. It may also be solid or fluid filled. It may also be wound or foamed, or it may contain fillers. On the other hand, the cover may also be single layer cover or multi-layer cover. The cover may be thin or thick. The cover may have a high hardness or low hardness to control the spin and feel of the ball. The cover may comprise a thermoplastic or a thermoset material, or both. Compositions and dimensions of the cover and the core have been fully discussed in the art, such as U.S. Pat. Nos. 6,419,535, 6,152,834, 5,919,100, 5,885,172, 5,783,293, 5,692,974, and PCT publication nos. WO 00/29129 and WO 00/23519, among many others. Any of the above factors can contribute to the CoR of the ball.

In accordance to one aspect of the present invention, a modified dimple pattern is provided to adjust incrementally the distance that the ball would travel without affecting the other qualities of the ball. As shown generally in FIGS. 3A and 3B where like numbers designate like parts, reference number 10 broadly designates a golf ball 10 having a plurality of dimples 12 separated by outer un-dimpled or land surfaces. As shown, dimples 12 are triangular. Suitable dimples for use with this invention include any polygonal dimples, including triangular, square, rectangular, pentagon, hexagon, heptagon, octagon or any other polygons. The present invention is not limited to any particular dimple shapes illustrated herein.

As used herein, "inter-dimple spacing" is the distance between any two adjacent dimples and "inter-sectional spacing" is the distance between any two adjacent identifiable sections of dimples. Inter-sectional spacing is also the inter-dimple spacing of adjacent dimples located in adjacent identifiable sections. Preferably, the spacings between any two adjacent dimples are substantially constant. In other words, the sides of adjacent dimples are substantially parallel to each other forming constant spacing between them, such as spacings 20 and 22 shown in FIGS. 3A and 3B.

In accordance to one aspect of the invention, at least some the inter-dimple spacings are different than the inter-sectional spacings. Alternatively, the inter-dimple spacings may vary throughout ball 10, while the inter-sectional spacings remain constant. Conversely, the inter-sectional spacings may vary throughout the ball, while the inter-sectional spacings remain constant. Alternatively, either the inter-dimple spacings or the inter-sectional spacings may vary, or both may vary. The inter-dimple spacings, as shown in FIGS. 3A and 3B, are also the width or the width of the land surface segments interposed between adjacent dimples within a section of dimples.

Figure 3A:
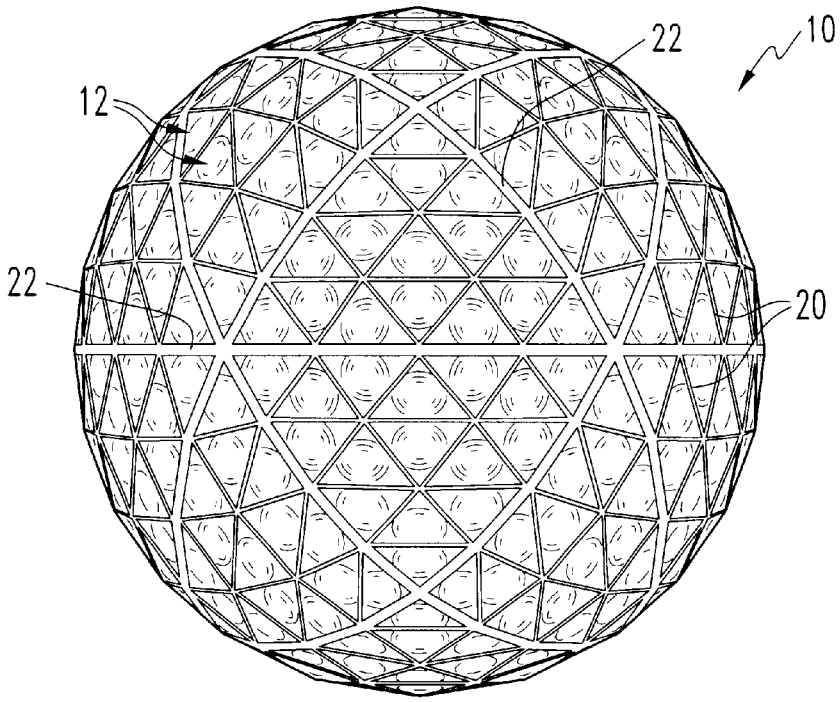
FIG. 3A is a plan view of a preferred embodiment of a golf ball in accordance to the present invention.
Figure 3B:
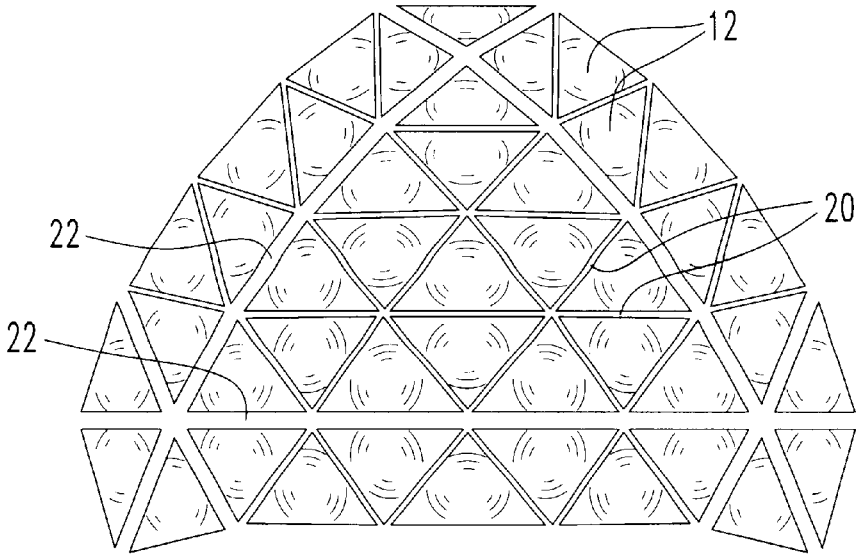
FIG. 3B is an enlarged view of a section of the golf ball of FIG. 3A.

The dimple pattern shown in FIG. 3A generally adheres to an icosahedron pattern, i.e., comprising twenty (20) identifiable triangular sections. One of the triangular sections is enlarged and shown in FIG. 3B. Within an identifiable triangular section, the inter-dimple spacings are preferably uniform and are designated as spacings 20. On the other hand, the spacings between the triangular sections are relatively larger and are designated as spacings 22. Preferably, spacings 22 are about 1.1 to about 5 times wider than spacings 20. Alternatively, when inter-dimple spacings 20 have the width of a thin line or effectively zero width, inter-sectional spacings 22 have a width of about 0.001 to about 0.040 inch, and more preferably about 0.002 inch to about 0.030 inch.

As shown in FIG. 3A, the inter-sectional spacings 22 form a number of great circles around the ball, and the inter-sectional spacings 22 have constant width and are thicker than the inter-dimple spacings, which are also constant on the ball. As illustrated, the inter-sectional spacings 22 follow the pattern of an icosahedron. Other suitable patterns include tetrahedron, octahedron, hexahedron and dodecahedron, among other polyhedrons, or any other discernable grouping of dimples. As stated above, spacings 20 and 22 may have varying width on the outer surface of the ball.

Figure 4:
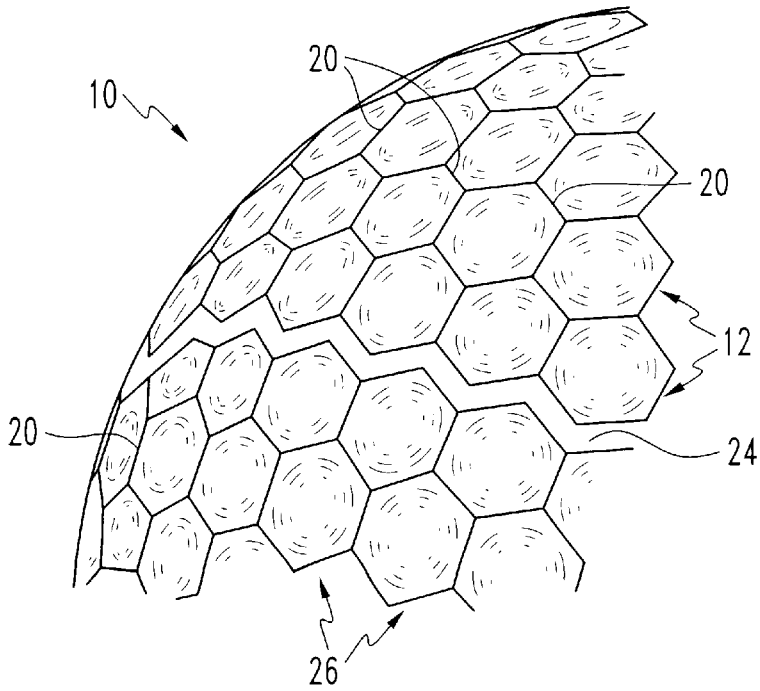
FIG. 4 is a partial plan view of another preferred embodiment in accordance to the present invention.
Figure 5:
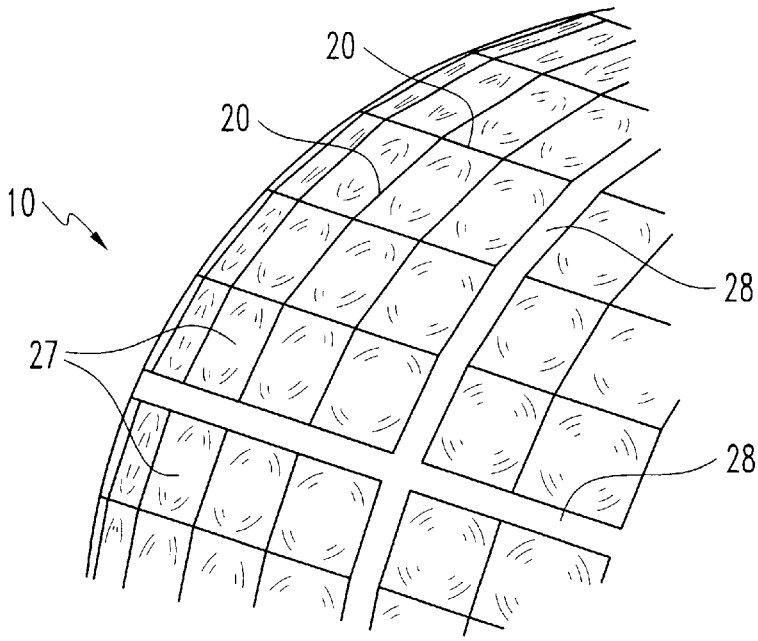
FIG. 5 is a partial plan view of another preferred embodiment in accordance to the present invention.

The inter-sectional spacings on the golf ball may form a single great circle, e.g., the equator, as shown in FIG. 4. The hexagonal/pentagonal dimples are separated by inter-sectional equatorial spacings 24. Dimples 26 are primarily hexagonal dimples, and the inter-dimple spacings 20 are preferably thin and may become thin lines where neighboring dimples meet as illustrated. Pentagonal and/or other polygonal dimples may be selectively inserted in the pattern to maximize dimple coverage. Inter-sectional spacings 24 preferably form non-linear or more specifically zigzag pattern as shown in FIG. 4. Alternatively, they may form linear pattern as shown in FIG. 5. FIG. 5 illustrates quadrilateral dimples 27 having inter-sectional spacings 28 forming two orthogonal great circles, where preferably one of the great circles is the equator of the ball. Other polygonal dimples may also be selectively inserted in this pattern to maximize dimple coverage. Again, the inter-dimple spacings 20 are preferably thin and may become thin lines where neighboring dimples meet. Also, the sides of adjacent dimples 26, 27 are substantially parallel to each other forming constant spacing therebetween.

Figure 6:
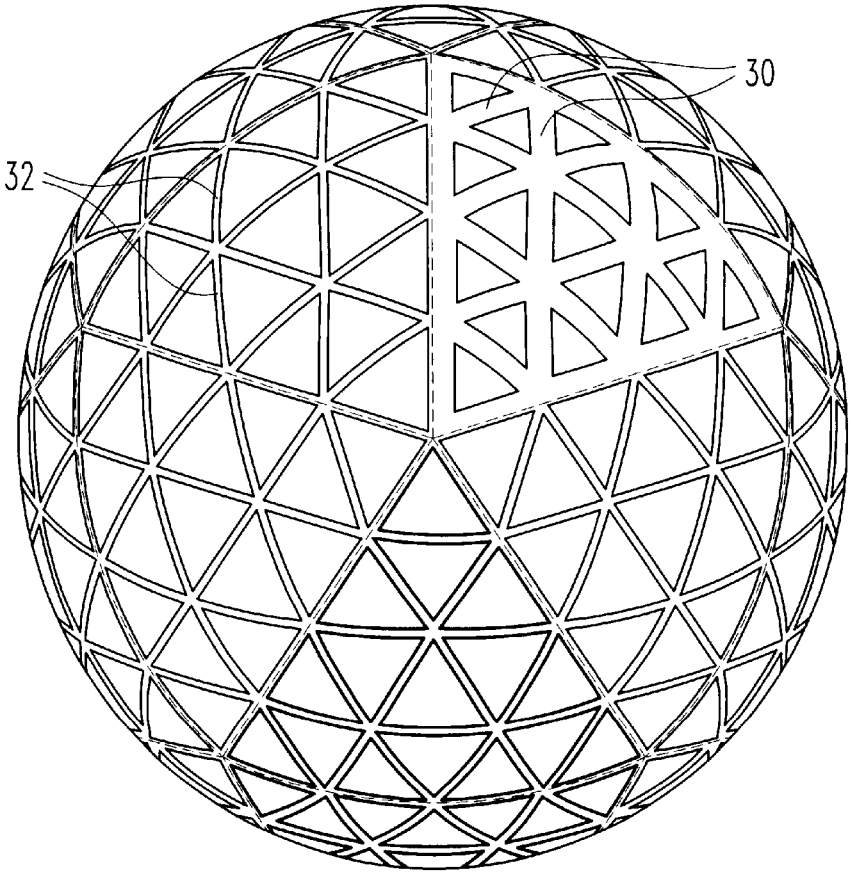
FIG. 6 is a plan view of another preferred embodiment in accordance to the present invention.
Figure 7:
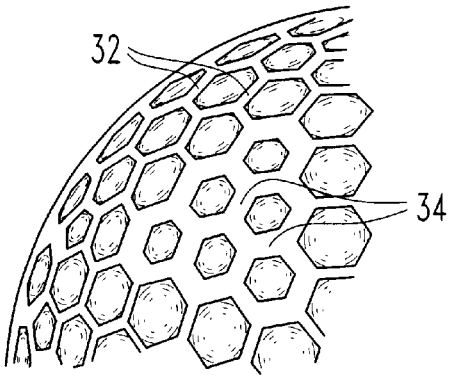
FIG. 7 is a partial plan view of another preferred embodiment in accordance to the present invention.
Figure 8:
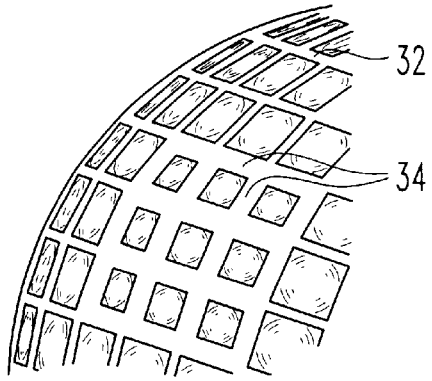
FIG. 8 is a partial plan view of another preferred embodiment in accordance to the present invention.

FIGS. 6, 7 and 8 illustrate other embodiments of the present invention. In selected sections, the inter-dimple spacings are the same within one section but are different than the inter-dimple spacings in other sections. For example, as shown in FIG. 6, triangular dimples are arranged in an icosahedron pattern having twenty (20) identifiable sections delineated by broken lines. In one or more of these sections, while the number of dimples is the same as other sections, these dimples are preferably smaller than other dimples on the ball, such that the inter-dimple spacings 30 within the selected sections are significantly larger than the inter-dimple spacings 32 in other sections. Preferably, the inter-dimple spacings 30 are constant within one section, but may be different from the inter-dimple spacings in other sections. Preferably, the sections with larger inter-dimple spacings 30 are evenly distributed around the surface of the ball to ensure a balanced golf ball. Again, the sides of adjacent dimples are substantially parallel to each other forming constant spacing therebetween.

Similarly, as shown in FIGS. 7 and 8 dimples in selective dimple groups may be separated by inter-dimple spacings 34 that have different width than the inter-dimple spacings 32 on other parts of the ball. Again, these dimple groups should be evenly distributed around the outer surface of the ball. Importantly, each dimple group may be contained within a single identifiable section on the golf ball, or it may straddle across two or more identifiable sections. Again, the sides of adjacent dimples are substantially parallel to each other forming constant spacing therebetween.

Figure 9:
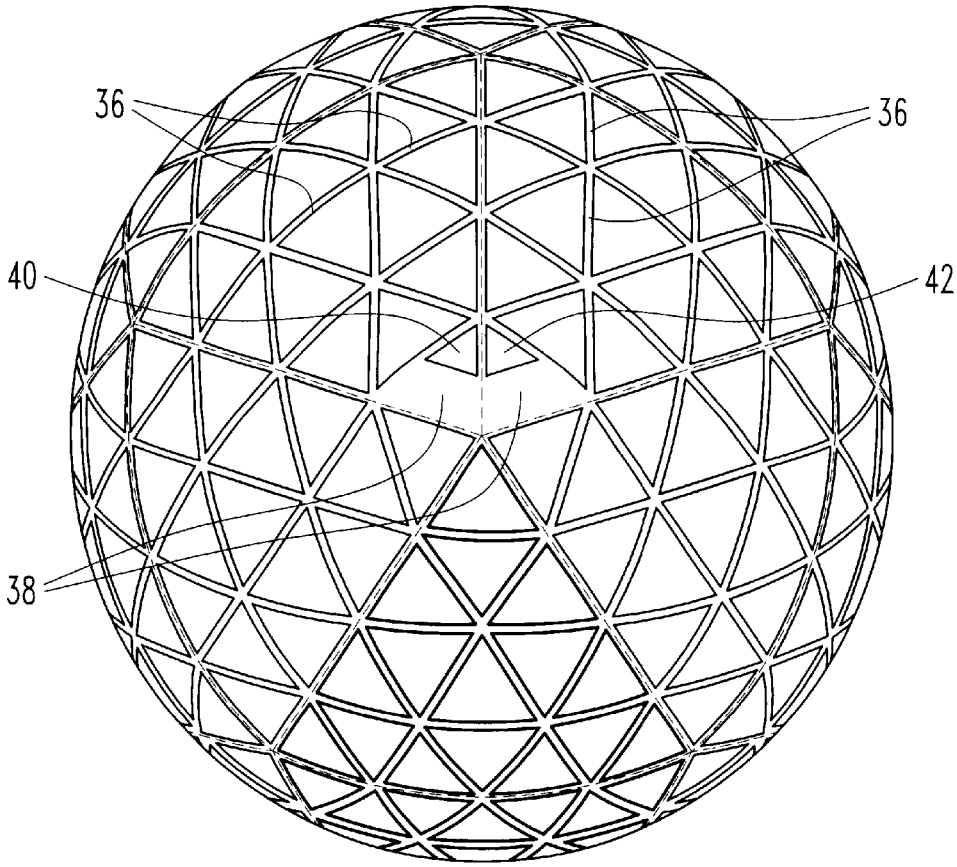
FIG. 9 is a plan view of another preferred embodiment in accordance to the present invention.
Figure 10:
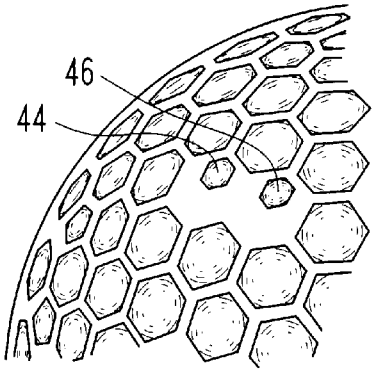
FIG. 10 is a partial plan view of another preferred embodiment in accordance to the present invention.
Figure 11:
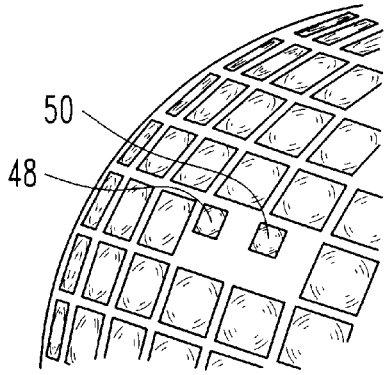
FIG. 11 is a partial plan view of another preferred embodiment in accordance to the present invention.

Alternatively, the inter-dimple spacings in a single identifiable section may be constant or may vary. As shown in FIG. 9, one of the identifiable icosahedron sections comprises at least two different inter-dimple spacings 36, 38. A single section may have any number of different inter-dimple spacings within it. As illustrated, adjacent dimples 40 and 42, while locating on different icosahedron sections, may have similar inter-dimple spacings 38 with other dimples. Similarly, as shown in FIGS. 10 and 11, adjacent dimples 44, 46 and 48, 50 may have inter-dimple spacings that are different than other dimples, regardless of their placement in any identifiable sections. Again, the sides of adjacent dimples are substantially parallel to each other forming constant spacing therebetween.

Preferably, inter-dimple spacings on a golf ball comprise enlarged spacings for selected dimples and thin spacings for the remaining dimples. The enlarged spacings are preferably about 1.1 to about 5 times larger than the thin spacings, and when the thin inter-dimple spacings approach a line or zero land areas, the enlarged spacings are preferably about 0.001 to about 0.040 inch, and more preferably about 0.002 inch to about 0.030 inch.

Figure 12:
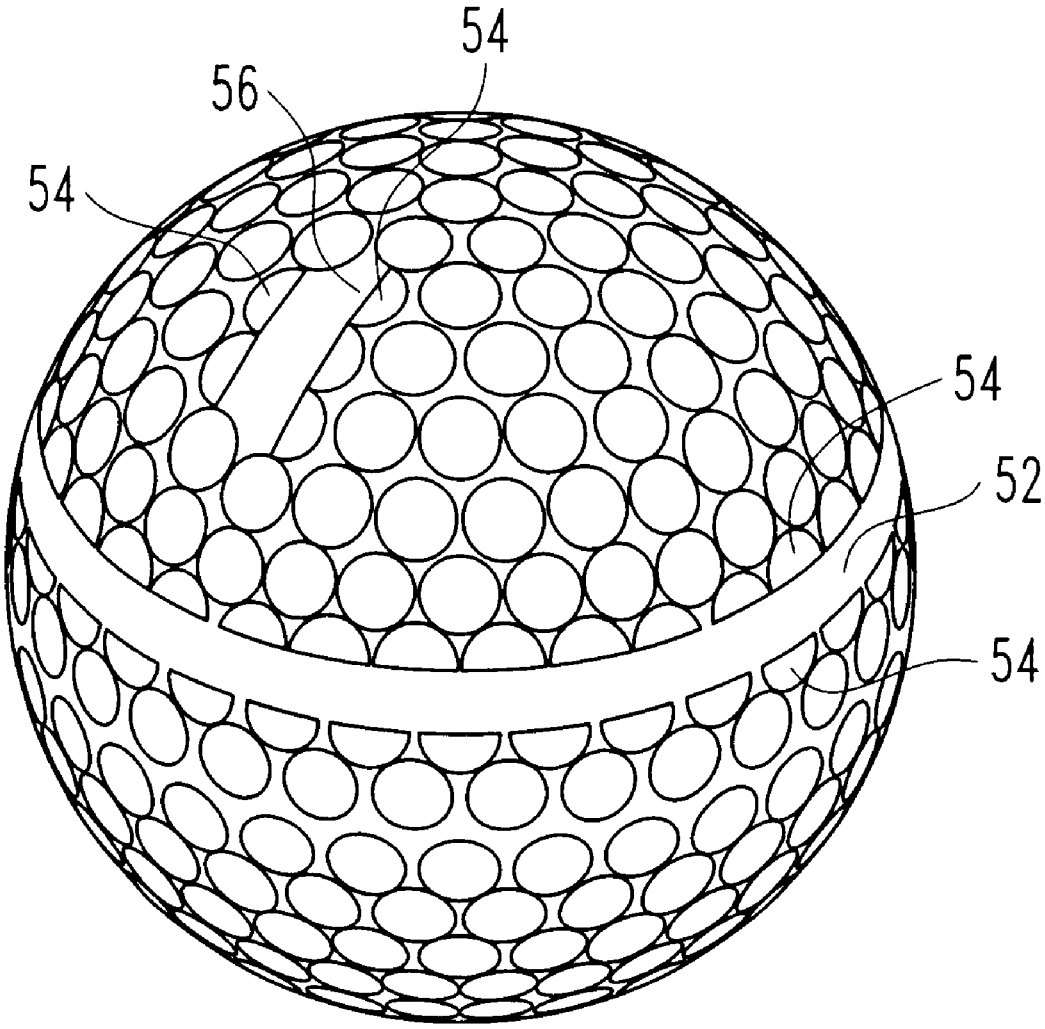
FIG. 12 is a plan view of another preferred embodiment in accordance to the present invention.

In accordance to another aspect of the present invention, enlarged inter-dimple spacings and inter-sectional spacings can be applied to conventional circular dimples, as shown in FIG. 12. As illustrated, inter-sectional spacings 52 form an equatorial pattern on a golf ball, which has mostly circular dimples. Preferably, inter-sectional spacing 52 is bordered by partially circular dimples 54. Each dimple 54 comprises one linear side that is positioned parallel to a corresponding linear side of an opposite dimple 54 forming constant spacing therebetween. Partially circular dimple 54 may comprise a linear side and a circular side, or a linear side and an arcuate side. Additionally, other inter-sectional spacings similar to those described above, such as other great circles, can also be used on a ball with circular dimples. Also, enlarged inter-dimple spacings 56 between adjacent dimples can also be formed between partially circular dimples 54 as shown in FIG. 12. Inter-dimple spacings 52 and 56 may have constant width or varying width.

In addition to polygonal and circular dimples, the inter-dimple spacings and intersectional spacings of the present invention can also be applied to other types of dimples, such as polygonal spherical dimples as described in co-pending application entitled "Golf Ball With Spherical Polygonal Dimples" filed on Feb. 15, 2002, Ser. No. 10/077,090. Other types of suitable dimples include polygonal dimples separated by a tubular lattice, described in U.S. Pat. No. 6,290,615B1, the isodiametrical dimples, described in U.S. Pat. No. 5,377,989, or the overlapping dimples, described in U.S. Pat. No. 4,960,282. The disclosures of these references are incorporated herein by reference. A tubular lattice comprises a plurality of connecting tubular projections disposed on the surface of the ball, wherein the cross-sectional profile of each projection has its apex located farthest from the center of the ball. An isodiametrical dimple comprises an odd number of sides and arcuate apices, wherein the sides have equal curvature. An overlapping dimple has a perimeter formed by placing two dimples, preferably circular dimples, in an overlapping manner.

As discussed above, one advantage of enlarging at least some of the inter-sectional spacings or inter-dimple spacings is to decrease selectively the dimple coverage, such that the distance that a high-performance golf ball would travel upon impact would adhere to the USGA distance limit. The varying inter-dimple spacings and inter-sectional spacings allow fine tuning of a highly efficient aerodynamic dimple pattern to adjust the distance that a ball would travel without switching to less efficient dimple patterns. Fine-tuning an efficient dimple pattern provides more certainty of achieving the desired result than experimenting with a completely different dimple pattern, or by changing the composition of the core and/or the cover to alter the CoR.

Tests have shown that distance generally increases with increasing dimple coverage, when all other aspects of the ball and tests are equal. Therefore, there is a great desire to produce dimple designs having as high coverage as possible. Preferably, the combined land area is less than 15% of the total outer surface area of the ball. As used herein, total land area is the sum of the areas of inter-dimple spacings 20 and inter-sectional spacings 22. When the inter-dimple spacings 20 approach zero, the total land area is the sum of the inter-sectional spacings 22.

The inter-dimple spacings and inter-sectional spacings of the present invention also impart distinctive outer markings on the ball. One advantage of having distinctive marking, e.g., the equatorial inter-sectional spacings shown in FIG. 4, is that such markings may assist the golfer's putting game by allowing the golfer to align the ball to the hole or to the putter. Also, individual designs for high performance balls may be produced with distinctive markings created by the varying inter-dimple spacings and inter-sectional spacings such that these balls would be easily distinguished from other manufacturers balls.

In a preferred embodiment, any of the inventive dimple patterns comprising varying inter-dimple spacings and/or inter-sectional spacings is utilized on the outer surface of a golf ball. The golf ball preferably comprises a core and a cover. The core may have one or more layers, and the cover may also have one or more layers. The inner cover layer or the outer cover layer may comprise a polyurethane, a polyurea, a polyurethane ionomer, a partially or fully neutralized ionomer, a metallocene catalyzed polymer, or blends thereof. Preferably, the outer cover layer has a thickness of about 0.015 inch to about 0.060 inch, and the inner cover layer has a thickness of about 0.015 inch to about 0.060 inch. Also, the outer cover layer preferably has a Shore D hardness of about 10 to about 70, and the inner cover layer has a Shore D hardness of about 40 to about 90. Also preferably the PGA compression of the ball is in the range of about 30 to about 100.

Hardness is preferably measured pursuant to ASTM D-2240 in either button or slab form on the Shore D scale. More specifically, Shore D scale measures the indentation hardness of a polymer. The higher Shore D value indicates higher hardness of the polymer.

Compression is measured by applying a spring-loaded force to the golf ball center, golf ball core or the golf ball to be examined, with a manual instrument (an "Atti gauge") manufactured by the Atti Engineering Company of Union City, N.J. This machine, equipped with a Federal Dial Gauge, Model D81-C, employs a calibrated spring under a known load. The sphere to be tested is forced a distance of 0.2 inch (5 mm) against this spring. If the spring, in turn, compresses 0.2 inch, the compression is rated at 100; if the spring compresses 0.1 inch, the compression value is rated as 0. Thus more compressible, softer materials will have lower Atti gauge values than harder, less compressible materials. Compression measured with this instrument is also referred to as PGA compression. The approximate relationship that exists between Atti or PGA compression and Riehle compression can be expressed as:

(Atti or PGA compression)=(160-Riehle Compression).

While various descriptions of the present invention are described above, it is understood that the various features of the embodiments of the present invention shown herein can be used singly or in combination thereof. For example, the dimple depth may be the same for all the dimples. Alternatively, the dimple depth may vary throughout the golf ball. The dimple depth may also be shallow to raise the trajectory of the ball's flight, or deep to lower the ball's trajectory. This invention is also not to be limited to the specifically preferred embodiments depicted therein.

What is claimed is:

1. A golf ball comprising:

a substantially spherical outer surface and a plurality of polygonal dimples formed thereon, said dimples are arranged such that the sides of adjacent dimples are substantially parallel to each other, and wherein the outer surface comprises first spacings and second spacings between adjacent dimples, wherein the first spacings and the second spacings have substantially constant width between any two adjacent dimples, the width of the first spacings being substantially zero, and the width of the second spacings being about 0.002 inch to about 0.03 inch, wherein the plurality of polygonal dimples are arranged in a plurality of identifiable sections and wherein the first spacings comprise inter-dimple spacings between dimples within one identifiable section and the second spacings comprise inter-sectional spacings between identifiable sections of dimples.

2. The golf ball of claim 1, wherein the polygonal dimples are arranged in a polyhedron based pattern, and at least some of the inter-sectional spacings form a single great circle.

3. The golf ball of claim 2, wherein the polyhedron based pattern comprises an icosahedron pattern, which comprises twenty identifiable triangular sections.

4. The golf ball of claim 1, wherein the inter-dimple spacings are constant within one identifiable section.

5. The golf ball of claim 4, wherein the inter-dimple spacings are constant among the identifiable sections.

6. The golf ball of claim 4, wherein the inter-dimple spacings vary among the identifiable sections.

7. The golf ball of claim 1, wherein the inter-sectional spacings are constant on the outer surface of the golf ball.

8. The golf ball of claim 1, wherein the inter-sectional spacings vary on the outer surface of the ball, and at least some of the inter-sectional spacings form two orthogonal great circles.

* * * * *